US009821823B2

(12) United States Patent
Aisa

(10) Patent No.: US 9,821,823 B2
(45) Date of Patent: Nov. 21, 2017

(54) TRACK CIRCUIT POWER SUPPLY VITAL MONITOR

(71) Applicant: ALSTOM TRANSPORT TECHNOLOGIES, Levallois-Perret (FR)

(72) Inventor: Pier Alessandro Aisa, Granarolo Emilia (IT)

(73) Assignee: ALSTOM TRANSPORT TECHNOLOGIES, Levallois-Perret (FR)

( * ) Notice: Subject to any disclaimer, the term of this patent is extended or adjusted under 35 U.S.C. 154(b) by 165 days.

(21) Appl. No.: 14/910,072

(22) PCT Filed: Aug. 9, 2013

(86) PCT No.: PCT/IB2013/056517

§ 371 (c)(1),
(2) Date: Feb. 4, 2016

(87) PCT Pub. No.: WO2015/019129

PCT Pub. Date: Feb. 12, 2015

(65) Prior Publication Data

US 2016/0176420 A1 Jun. 23, 2016

(51) Int. Cl.
*B61L 1/18* (2006.01)
*B61L 1/20* (2006.01)

(52) U.S. Cl.
CPC ..... *B61L 1/181* (2013.01); *B61L 1/187* (2013.01); *B61L 1/188* (2013.01); *B61L 1/20* (2013.01)

(58) Field of Classification Search
CPC .. B61L 1/18; B61L 1/181; B61L 1/182; B61L 1/183; B61L 1/184; B61L 1/185; B61L 1/186; B61L 1/187; B61L 1/188
(Continued)

(56) References Cited

U.S. PATENT DOCUMENTS 3,868,075 A * 2/1975 Blazek ..... B61L 23/168 246/34 CT
4,652,986 A * 3/1987 Kolkman ..... B61L 1/18 361/87

(Continued)

FOREIGN PATENT DOCUMENTS

BE 540388 A 7/1959
EP 0165048 A2 12/1985

*Primary Examiner* — Jason C Smith
(74) *Attorney, Agent, or Firm* — Themis Law

(57) ABSTRACT

A power supply vital monitor for track circuits for railway systems includes a track segment that is separated from adjacent segments by electric joints. Each track segment includes a signal transmitting unit and receiving units for transmitting and receiving train presence detection signals and/or transmitting or receiving communication signals between the train and the track segment. The transmitting unit and receiving units are connected to a common power supply line. To avoid an erroneous clearing of an occupied status caused by spurious signals on the power supply line affecting reception of the train detection signals, each receiving unit includes a first and a second channel, which connect the receiver with the corresponding track circuit and with a power supply sensor connected to the power supply line. Switches enable and disable connections of the receivers to the corresponding track circuit and to the corresponding power supply sensor.

9 Claims, 2 Drawing Sheets

(58) Field of Classification Search
USPC ..... 246/219
See application file for complete search history.

(56) References Cited

U.S. PATENT DOCUMENTS

| | | | | |
|---|---|---|---|---|
| 5,666,382 | A * | 9/1997 | Thakore | B61L 3/24 348/384.1 |
| 2007/0132463 | A1* | 6/2007 | Anderson | B61L 23/044 324/713 |
| 2008/0067293 | A1* | 3/2008 | Fries | B61L 1/181 246/293 |
| 2008/0142645 | A1* | 6/2008 | Tomlinson | B61L 23/044 246/122 R |
| 2011/0147535 | A1* | 6/2011 | Aisa | B61L 1/187 246/122 R |
| 2014/0041980 | A1* | 2/2014 | Noffsinger | B61L 1/181 191/45 R |
| 2015/0158510 | A1* | 6/2015 | Fries | B61L 1/181 701/19 |
| 2016/0152251 | A1* | 6/2016 | Aisa | B61L 1/187 246/121 |
| 2016/0176420 | A1* | 6/2016 | Aisa | B61L 1/187 246/219 |

* cited by examiner

TRACK CIRCUIT POWER SUPPLY VITAL MONITOR

The invention relates to a track circuit power supply vital monitor for a track circuit for railway systems or the like, comprising a track segment of predetermined length, electrically insulated from adjacent segments by electric joints, each consisting of a conductor, which connects together the rails at the ends of said track segments.

Each track segment comprises electric signal transmitting units and receiving units for transmitting and receiving train presence detection signals within the track segment and/or transmitting or receiving communication signals between the train and the track segment.

Furthermore each transmitting unit and each receiving unit is connected to a common power supply line.

Therefore the invention is directed to the railways in which the insulation from a track segment to the adjacent one is obtained through electric joints and consequently there is no mechanical separation between two adjacent track segments, the rails of each track segment are welded together and each track circuit is distinguished from the adjacent one due to the presence of an impedance between the rails.

According to the configuration of some track circuits belonging to the state of the art, particularly used in the United States, the transmission and the reception of signals are carried out on the same cable, in particular on the same cable the transmission of a signal relating to a track circuit and the reception of another signal relating to another track circuit are present.

This feature in combination with a common distribution of the power supply leads to malfunctions relating to the detection of the correct signal by the receiving units.

In fact the communication between receiving and transmitting units through the power supply line allows the transmitting units to send signals to receiving units that are not related to the track circuit and therefore do not contain any information relating the presence or absence of the train.

This feature has a particularly negative aspect if the transmitting units transmits to the receiving units, through the power supply line, a disturbing spurious signal that presents the same features, carrier frequency and amplitude, of the one that refers to the train detection in the track circuit.

As an example, a train with its axles enters in a track circuit, the receiving units connected to that track circuit sense the shunt resistance of the train and correctly put the track circuit in occupied status.

In the same moment another track circuit transmitting units connected on the same power supply of the previous receiving units generate for another track circuit the same frequency used by the receiving units and propagates through the power supply line a ripple at the same frequency.

The receiving units receive the spurious signal not from the track, where the train is located, but from the power supply. This spurious signal, under certain conditions, can clear the track circuit even if the train is still present. This represent a safety hazard because the track circuit is declared clear, another train can enter on it causing an accident.

This drawback relates not only the analog systems, but also the track circuit systems where an analog-digital conversion is provided, because the digital samples can be affected by the ripple generated on the power supply line when the analog to digital conversion occurs.

The track circuit systems belonging to the state of the art solves this problem providing each transmitting unit and each receiving unit with a dedicated and independent power supply unit, in order to avoid the propagation of these spurious signals through the common power supply line.

As it can be appreciated by the discussion above, the solution adopted by the track circuits belonging to the state of the art requires additional components, such as power supply unit dedicated to each track segment.

The use of dedicated components brings functional and economical drawbacks.

From a functional point of view, the addition of one or more components to the track circuit increases the possibility of failures of the track circuit and it requires more controls.

The economical drawbacks are obvious since there is an increase of costs, due not only to the purchase of a specific product, but also to the maintenance required.

The scope of the present invention is to solve the safety hazard related to failures of power supply that can lead to an undetected train axle on track circuit products, due to noisy frequency that propagates through the power supply line.

The present invention fulfils such scope by providing a track circuit power supply vital monitor as described in the preamble of claim 1, in which each receiving unit comprises at least two parallel signal processing channels, a first and a second channel, which processing channels are constituted by a receiver connected to the track circuit and to a power supply sensor connected to the power supply line through communication lines.

Each communication line has a first enabling/disabling device in order to enable/disable the connection of the receiver with the corresponding track circuit and a second enabling/disabling device in order to enable/disable the connection of the receiver with the power supply sensor.

The receivers are connected to an analyzing unit, which analyzes the output signals of the receivers, being provided means for setting the track circuit in a safety condition.

The proposed approach removes any safety constraints on power supply voltage generation by safe monitoring the power supply on the track circuit and, therefore, it leads to costs and spaces savings in respect of the track circuit belonging to the state of the art.

The solution presented embeds the safety check of the correctness of power supply, by giving the freedom to the user to select power supply without safety constraints on track circuit products, in the sense that no safety requirements will be applied to the power supply product and therefore each customer can select the power supply solution that prefer.

Thanks to the configuration described, the receiving units comprises two signal processing channels that can be dedicated one to the communication between one receiver and the track circuit and the other to the communication between the other receiver and the power supply monitor.

Consequently the proposed invention avoid safety hazard described above, because is able to monitor the power supply detecting the spurious signal coming from the power supply line and therefore force to maintain occupied the track circuit in which the train is located.

To declare clear a track circuit, absence of trains or trolley on the rails, the track circuit power supply vital monitor belonging to the invention, will look not only at the signal coming from the track circuit, but also will look at the signal coming from the power supply, to certify that spurious signals coming from the power supply can not affect the safe operation of the track circuit.

Further advantages of the present invention can be identified in a reduction of the total space needed and a consequent reduction of total costs, in respect of traditional power supply installations with safety constraints and dedicated power supply units for each track segment.

According to a preferred embodiment each receiving unit comprises timing means which activate the first and second enabling/disabling devices of each communication line according to predetermined timing rules. According to an improvement of the present invention, the timing means comprise processor means for executing a logical program, in order to set a timing rule that controls the activation of the enabling/disabling devices.

The execution of the logical program causes enabling/disabling devices to operate in such a way that the activation of the first enabling/disabling device of the first channel deactivate the second enabling/disabling device of the first channel and the first enabling/disabling device of the second channel and activate the second enabling/disabling device of the second channel, and vice versa.

The result of this execution is a continuous and alternative activation of the communication between the receivers and, respectively, the power supply sensor and the track circuit.

Advantageously the power supply sensor comprises analyzing means to compare the power supply signal with characteristic parameters uniquely identifying the train presence detection signals.

According to a further embodiment, the receivers has a processing and control section configured as a 2oo2 architecture.

This feature allows to increase the safety of the track circuit system according to the present invention.

The two out of two configuration, also known as 2oo2, is a well known topological architecture and its uses and advantages in the technical field of train detection is described in the document EP 2090491 whose information content is integrated herein.

The present invention relates also to a method to evaluate failure of power supply in track circuits for railway systems or the like, wherein the track circuits comprise a track segment of predetermined length, electrically insulated from adjacent segments by electric joints, each consisting of a conductor, which connects together the rails at the ends of the track segments.

The track segment comprises electric signal transmitting units and receiving units for transmitting and receiving train presence detection signals within said track segment and/or transmitting or receiving communication signals between the train and the track segment, being each transmitting unit and each receiving unit connected to a common power supply line.

Each receiving unit comprises at least two parallel signal processing channels, a first and a second channel, which are constituted by a receiver connected to the track circuit and to a power supply sensor connected to the power supply line through communication lines. Each communication line has a first enabling/disabling device in order to enable/disable the connection of the receiver with the corresponding track circuit and a second enabling/disabling device in order to enable/disable the connection of the receiver with the power supply sensor.

The method of the present invention provides the step of:

a) analysis of the signals received by the receiving units through two processing channels, b) connection of the receiver belonging to the first signal processing channel to the track circuit and disconnection of the receiver belonging to the first signal processing channel to the power supply sensor, disconnection of the receiver belonging to the second signal processing channel to the track circuit and connection of the receiver belonging to the second signal processing channel to the power supply sensor, c) analysis of output signals of the receivers, through an analyzing unit, d) set of the status of the track segment according to the output signal of the analyzing unit.

As described above the method according to the invention allow to identify if a signal received by the receiving units is coming effectively from the track circuit and consequently it brings information referring to the presence/absence of train or if the signal is a result of noises occurring in the common power supply line.

Preferably the step b) is obtained activating the first enabling/disabling device belonging to the first processing channel and of the second enabling/disabling device belonging to the second processing channel and deactivating of the second enabling/disabling device belonging to the first processing channel and of the first enabling/disabling device belonging to the second processing channel.

Advantageously the activation/deactivation of the first and of the second enabling/disabling devices is obtained according to predetermined timing rules, each receiving unit comprising timing means which activate/deactivate the first and second enabling/disabling devices.

These and other characteristics and advantages of the invention will be more apparent from the following description of a few embodiments shown in the accompanying drawings, in which.

Figure 1:
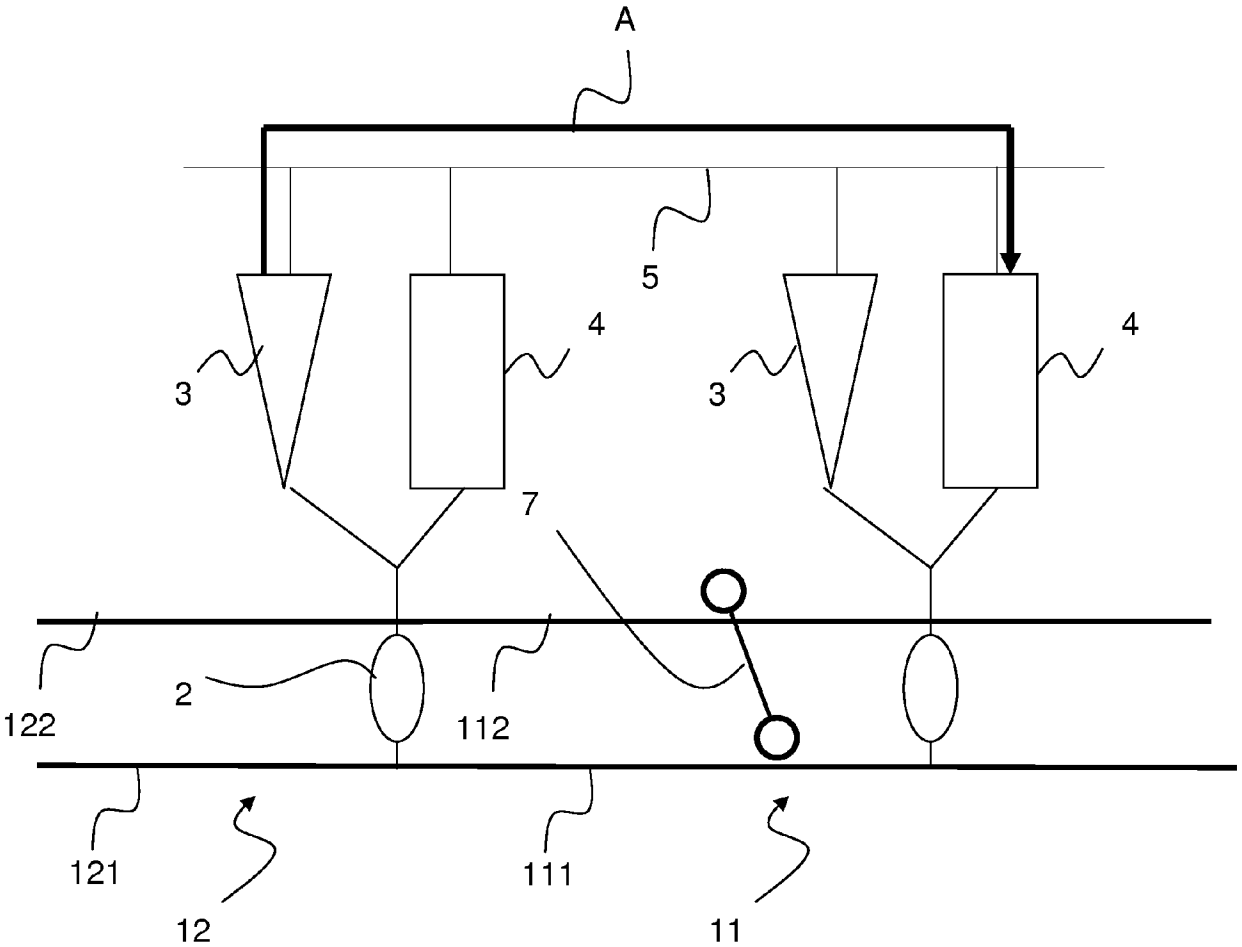
FIG. 1 shows a functional scheme of a typical track circuit.

FIG. 1 shows a track circuit for railway systems or the like, comprising a track segment 11 of predetermined length, electrically insulated from adjacent segments 12 by electric joints 2, each consisting of a conductor, which connects together the rails 111, 112 at the ends of the track segment 11.

The track segments 11, 12 comprise electric signal transmitting units 3 and receiving units 4 for transmitting and receiving train presence detection signals within each track segment and/or transmitting or receiving communication signals between a train 7 and the track segments 11, 12.

Each transmitting unit 3 and each receiving unit 4 is connected to a common power supply line 5.

In the track circuits belonging to the state of the art that present the configuration of FIG. 1, the train 7 enters in the track circuit 11, the receiving units 4 connected to that track circuit sense the shunt resistance of the train 7 and put the track circuit 11 in occupied status.

In the same moment the transmitting unit 3 on the left in FIG. 1, connected on the same power supply line of the receiving unit 4 on the right in FIG. 1, generates for another track circuit a signal of the same frequency used by the receiving units 3 and propagates through the power supply line 5 a ripple A at the same frequency, as indicated with the arrow in FIG. 1.

The receiving unit 4 on the right receives the ripple A, considered as a spurious signal, not from the track segment 11, where the train is located, but from the common power supply line 5.

All carrier frequencies of signals are modulated ON/OFF, each speed code to be transmitted inside the track circuit is identified by a period of presence of a predetermined frequency and by a period of absence of the said frequency.

To obtain this ON/OFF modulation the transmitting units 3 changes the electricity consumption, increasing and decreasing the voltage of the power supply line: this brings to the generation of spurious signal that can present the same features of the track circuit signal that the receiving units expect.

This spurious signal that is propagating as ripple through the power supply line 5 can clear the track circuit even if the train is still present.

Figure 2:
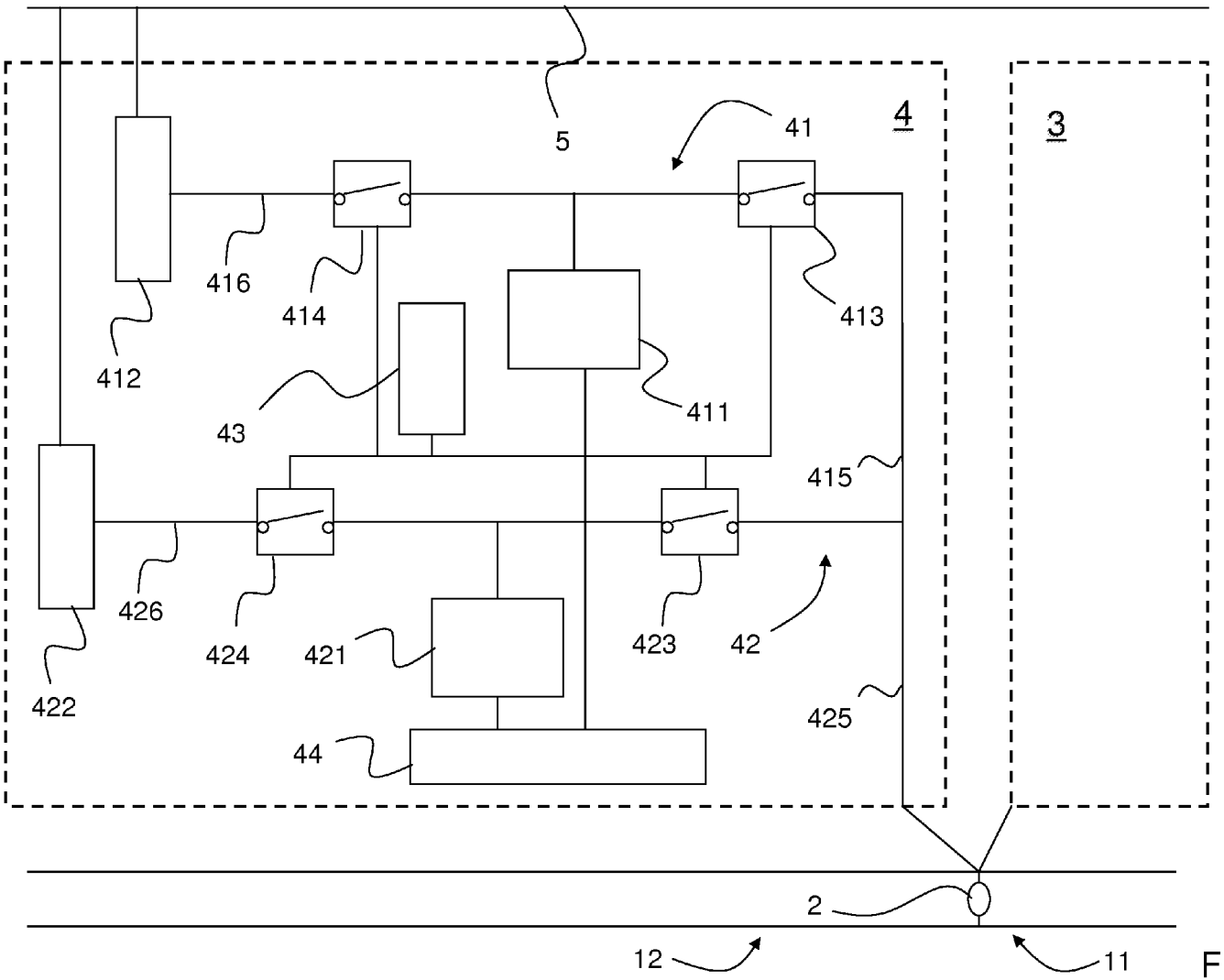
FIG. 2 shows a functional scheme of the track circuit power supply vital monitor belonging to the present invention according to a preferred embodiment.

FIG. 2 shows a functional scheme of the receiving unit 4 of FIG. 1 according to the present invention.

The receiving unit 4 comprises two parallel signal processing channels, a first channel 41 and a second channel 42.

The input signal of the receiving unit 4 is therefore transmitted to the two signal processing channels constituted by a receiver 411, 421 connected to the track circuit and to a power supply sensor 412, 422 connected to the power supply line 5, through communication lines.

In particular each receiver 411, 421 is connected to the track circuit through a corresponding communication line 415, 425 and to a power supply sensor 412, 422 through a corresponding communication line 416, 426.

Each communication line has a first enabling/disabling device 413, 423 in order to enable/disable the connection of the receiver 411, 421 with the corresponding track circuit and a second enabling/disabling device 414, 424 in order to enable/disable the connection of the receiver 411, 421 with the power supply sensor 412, 422.

Furthermore the receiving unit 3 comprises timing means 43 which activate the first and second enabling/disabling devices 413, 423; 414, 424 of each communication line according to predetermined timing rules.

The receivers 411, 421 are connected to an analyzing unit 44, which analyzes the output signals of the receivers, According to an improvement of the present invention the analyzing unit 44 can communicate with means for setting the track circuit in a safety condition.

As it clearly appears from FIG. 2, the timing means 43 control the connection of the receivers 411, 421 and consequently the output signals of the same transmitted to the analyzing unit 44.

The enabling/disabling devices 413, 423; 414, 424 can be switched that enables/disable the conductivity in each communication lines realized, for example, with MOS transistor.

According to a preferred embodiment, the timing means 43 comprise processor means for executing a logical program, the execution of said logical program causes said enabling/disabling devices 413, 423; 414, 424 to operate in such a way that the activation of the first enabling/disabling device 413 deactivate the second enabling/disabling device 414 and the first enabling/disabling device 423 and activate the second enabling/disabling device 424.

In this configuration the receiver 411 is connected to the track circuit, while the receiver 421 is connected to the power supply sensor 422, so each receiver can be alternatively and continuously connected to the power supply sensor or to the track circuit.

This means that the analyzing unit 44 processes a signal coming not only from the track circuit, but also from the power supply sensors 421, 422, in order to identify dangerous spurious signal coming from the power supply line 5.

For example it can be assumed that the receiver 411 is connected to the track circuit and disconnected to the power supply sensor 412, while the receiver 421 is connected to the power supply sensor 422 and disconnected to the track circuit.

If the receiver 421 receives a signal that presents the same feature, carrier frequency and amplitude, of the track circuit signal that the receiving unit 3 expect to receive, it means that the signal comes from the power supply line 5 and therefore it has not to be identified as indicating the presence or absence of a train in the track circuit.

The analyzing unit 44 compares the signals coming from the receivers 411 and 421 and it controls the means for setting the track circuit in a safety condition.

In the case the output signals of the receivers 411 and 421 diverge, the track circuit is set in occupied status.

The same considerations are valid if the receiver 421 is connected to the track circuit and disconnected to the power supply sensor 422, while the receiver 411 is connected to the power supply sensor 412 and disconnected to the track circuit.

The power supply signal can be detected by the receivers 411, 421 or by the power supply sensors 412, 422. In the second case, according to a preferred embodiment, the power supply sensor 412 and 422 comprise analyzing means to compare the power supply signal with characteristic parameters uniquely identifying the train presence detection signals.

According to a further improvement of the track circuit power supply vital monitor of the present invention, the receivers 411, 421 has a processing and control section configured as a 2oo2 architecture.

The invention claimed is:

1. A track circuit comprising:

a power supply vital monitor adapted to monitor a power supply signal of railway systems;

a plurality of track segments (11, 12) of predetermined length, forming continuous rails, and electric joints (2), each consisting of a conductor, which connects together the rails (111, 112) at ends of each track segments; and electric signal transmitting units (3) and receiving units (4) operatively coupled to each track segment (11, 12) and adapted to receive and transmit train presence detection signals within each track segments and/or transmit communication signals between a train (7) and the track segments (11, 12), each transmitting unit (3) and each receiving unit (4) being connected to a common power supply line (5), wherein:

each receiving unit (4) comprises at least two parallel signal processing channels, which include a first (41) and a second (42) channel, each channel (41, 42) comprising a receiver (411, 421) connected to the track circuit and to a respective power supply sensor (412, 422) connected to a common power supply line (5) through communication lines, each single communication line connecting the receiver with both the track circuit and the respective power supply sensor, each communication line having a first enabling/disabling device (413, 423) in order to enable/disable a connection of the said receiver (411, 421) with the corresponding track circuit, and a second enabling/disabling device (414, 424) in order to enable/disable the connection of the said receiver (411, 421) with the power supply sensor (412, 422), and the receivers (411, 421) being connected to an analyzing unit (44), which analyzes output signals of the said receivers (411, 421).

2. The track circuit according to claim 1, wherein each receiving unit comprises a timing device (34), which activates the first and second enabling/disabling devices (413, 414, 423, 424) of each communication line according to predetermined timing rules.

3. The track circuit according to claim 2, wherein the timing device (43) comprises a processor means for executing a logical program, wherein execution of said logical program causes said first and said second enabling/disabling devices (413, 414, 423, 424) to operate in such a way that activation of the first enabling/disabling device (413) of the first channel (41) deactivates the second enabling/disabling device (414) of the first channel (41) and the first enabling/disabling device (423) of the second channel (42) and activate the second enabling/disabling device (424) of the second channel (42), and vice versa.

4. The track circuit according to claim 1, further comprising a system that sets the track circuit in a safety-condition.

5. The track circuit according to claim 1, wherein the power supply sensor (412, 422) comprises an analyzing system that compares a power supply signal with characteristic parameters uniquely identifying the train presence detection signals.

6. The track circuit according to claim 1, wherein the receiver (411, 421) has a processing and control section configured as a 2oo2 architecture.

7. A method to evaluate failure of power supply in a track circuit for railway systems or the like, wherein the track circuit comprises:

a plurality of track segment (11, 12) of predetermined length, forming continuous rails, and electric joints, each consisting of a conductor, which connects together the rails (111, 112) at ends of each track segments, and electric signal transmitting units (3) and receiving units operatively coupled with each track segment (11, 12) for transmitting and receiving train presence detection signals within each track segments and/or transmitting or receiving communication signals between a train (7) and the track segments, each transmitting unit (3) and each receiving unit (4) being connected to a common power supply line (5), the method comprising:

a) analyzing the signals received by the receiving units (4) through two processing channels, each receiving unit (4) comprising at least two parallel signal processing channels (41, 42), which include a first and a second channel, each processing channel comprising a receiver (411, 421) connected to the track circuit and to a respective power supply sensor (412, 422) connected to the common power supply line (5), through communication lines, each single communication line connecting the receiver with both the track circuit and the respective power supply sensor, each communication line having a first enabling/disabling device (413, 423) adapted to enable/disable a connection of the said receiver (411, 421) with the corresponding track circuit and a second enabling/disabling device (414, 424) adapted to enable/disable the connection of the said receiver (411, 421) with the power supply sensor (412, 422);

b) connecting the receiver (411, 421) belonging to the first signal processing channel (41) to the track circuit and disconnecting the receiver (411, 421) belonging to the first signal processing channel (41) to the power supply sensor, disconnecting the receiver (411, 421) belonging to the second signal processing channel (42) to the track circuit and connecting the receiver (411, 421) belonging to the second signal processing channel (42) to the power supply sensor (412, 422);

c) analyzing output signals of said receivers (411, 421) through an analyzing unit (44); and d) setting a status of the track segment (11) according to the output signal of the analyzing unit (44).

8. The method according to claim 7, wherein step b) is achieved by activating the first enabling/disabling device (413) belonging to the first processing channel (41) and the second enabling/disabling device (424) belonging to the second processing channel (42) and deactivating the second enabling/disabling device (414) belonging to the first processing channel (41) and the first enabling/disabling device (423) belonging to the second processing channel (42).

9. The method according to claim 8, wherein the activating/deactivating of the first and of the second enabling/disabling devices is achieved according to predetermined timing rules, each receiving unit comprising a timing device (43) which activates/deactivates the first and second enabling/disabling devices (413, 414, 423, 424).

* * * * *